US007185872B2

(12) United States Patent
Lowenstein, Jr.

(10) Patent No.: US 7,185,872 B2
(45) Date of Patent: Mar. 6, 2007

(54) APPLIANCE STABILIZING DEVICE

(76) Inventor: Arnold G. Lowenstein, Jr., 26867 Pelham Pl., Hayward, CA (US) 94542

( * ) Notice: Subject to any disclaimer, the term of this patent is extended or adjusted under 35 U.S.C. 154(b) by 40 days.

(21) Appl. No.: 10/954,938

(22) Filed: Sep. 30, 2004

(65) Prior Publication Data

US 2005/0051697 A1 Mar. 10, 2005

Related U.S. Application Data

(63) Continuation-in-part of application No. 10/389,029, filed on Mar. 17, 2003, now abandoned.

(51) Int. Cl.
*A47B 97/00* (2006.01)

(52) U.S. Cl. ..... 248/500; 248/680; 248/681

(58) Field of Classification Search ..... 248/500, 248/680, 681, 675, 288.11; 312/245, 247
See application file for complete search history.

(56) References Cited

U.S. PATENT DOCUMENTS

| | | | | |
|---|---|---|---|---|
| 545,098 | A * | 8/1895 | Schloss | 312/101 |
| 3,993,027 | A * | 11/1976 | Mullin | 119/706 |
| 4,967,993 | A | 11/1990 | Wilson | 248/475.1 |
| 5,076,525 | A * | 12/1991 | Whipple | 248/300 |
| 5,174,543 | A * | 12/1992 | Corson et al. | 248/680 |
| 5,192,123 | A * | 3/1993 | Wallin | 312/351.7 |
| 5,516,067 | A | 5/1996 | Schiele | 248/220.21 |
| 6,460,820 | B1 * | 10/2002 | Kopp | 248/500 |
| 6,533,238 | B2 | 3/2003 | Barnes et al. | 248/680 |
| D512,903 | S * | 12/2005 | Gallien | D8/349 |
| 2004/0211878 | A1 * | 10/2004 | Orozco | 248/679 |

FOREIGN PATENT DOCUMENTS

| | | | |
|---|---|---|---|
| CA | 2312680 | * | 6/1999 |

* cited by examiner

*Primary Examiner*—Amy J. Sterling
(74) *Attorney, Agent, or Firm*—Shirley L. Church

(57) ABSTRACT

An appliance stabilizing device which is useful in securing an appliance in position against a supporting structure surface. The device includes a plurality of brackets which are selectively positionable on an appliance, with a plurality of elongated members, each pivotally attached to a bracket. Each elongated member has at least one aperture spaced a distance along the length of the elongated member from the pivotal point with the bracket. The elongated member is attached to a support surface, typically a baseboard and/or a wall. The bracket includes apertures spaced from each other in a generally triangular configuration, and the elongated member is typically pivotally attached at the apex of the generally triangular configuration of apertures. The device is self adjusting during attachment of the appliance to a supporting structure.

5 Claims, 3 Drawing Sheets

APPLIANCE STABILIZING DEVICE

The present application in a continuation-in-part of application Ser. No. 10/389,029, filed Mar. 17, 2003 now abandoned, titled: "Appliance Stabilizing Device".

BACKGROUND OF THE INVENTION

1. Field of the Invention

The present invention relates to appliance securing members and more particularly pertains to a new appliance securing member for selectively securing an appliance to a wall, to prevent the tipping of the appliance.

2. Description of the Background Art

The use of appliance securing members is known in the art. U.S. Pat. No. 5,076,525 describes a pair of brackets, one attached to the appliance and one to a wall, which brackets are coupled together to prevent tipping of the appliance. U.S. Pat. No. 4,754,948 describes a bracket which is attached to an appliance, a wall and a floor. U.S. Pat. No. 4,890,813 includes a bracket which is attached to the floor for anchoring the rear feet of an oven.

While these devices do assist in the securing of an appliance to a surface, with the intent of securing the appliance in place, one skilled in the art will recognize that there remains a need for a securing device which permits more flexibility in the positioning of the appliance, and which provides better support when the appliance is a heavy appliance which is inclined to tip over. In addition, when there is a possibility of earthquake at the location where the appliance is being used, it becomes critical that the appliance securing device handle the load which may be applied to the securing device in the event of an earthquake.

SUMMARY OF THE INVENTION

The present device which is useful in securing an appliance in position against a supporting surface includes a plurality of brackets which are selectively positionable on an appliance, with a plurality of elongated members, each pivotally attached to a bracket, where each elongated member has at least one aperture spaced a distance along the length of the elongated member from the pivotal point with each bracket. The elongated member is then attached to a support surface, typically a wall or a baseboard of a wall, by adhering a fastener which is retained in an aperture on the elongated member to the support surface. Typically the fastener is adhered to the wall by screwing the fastener into the wall. In some instances there may be an anchor which has been inserted into the wall surface and the fastener is inserted into the anchor. Such wall anchors are commonly known in the art.

Each bracket includes a plate, with the plate having at least three apertures extending through the plate. The apertures are spaced from each other to form a generally triangular configuration, or another configuration providing stability at least equal to that provided by the triangular configuration. At least one elongated member is pivotally attached to each bracket. When the bracket includes apertures spaced from each other in a generally triangular formation, the elongated member is typically pivotally attached to the bracket at the apex of said generally triangular formation, with the base of the triangular formation being attached to the appliance at least two locations on the base of the triangular formation.

The use of an attachment arm, elongated member, which is pivotal with respect to the point of attachment to the appliance permits a degree of self adjustment of the appliance with respect to the point of attachment of the elongated member to the support surface. This self adjustment enables an easier installation at the time the appliance is attached to the wall. It is also helpful in providing stability in case of an earthquake or other shock to the appliance which might otherwise cause the appliance to tend to tip over. Further, the self adjustment feature of the attachment device makes it possible to adjust the height of the appliance using the leveling devices typically present at the base of the appliance subsequent to fastening of the appliance to the wall or other support structure, if necessary.

When the end of the elongated member of the appliance attachment device which is attached to the support structure is attached to a wall or wall baseboard, the attachment of the plurality of brackets to the appliance is typically made at a height, measured from the bottom of the appliance, which ranges from about ¼ to about ½ of the height of the appliance. The attachment to the wall or wall baseboard is then made at a location which is at a height which is relatively near the bottom of the appliance. This arrangement of attachment points relative to the appliance height transfers a load from the appliance through the bracket to the elongated member, and to the point of attachment at the wall or wall baseboard, in combination with the pivotal ability in a plane with respect to the brackets, directs the fastener in the wall or baseboard to move upward through the wall material or the wall baseboard material, rather than to pull directly out in a direction perpendicular to the wall or wall baseboard. This significantly improves the probability that the appliance will not tip over when the appliance is subjected to a tipping force.

The brackets and elongated members may be made of any high strength material, including composite materials of the kind known in the construction industry in general. However, the brackets are typically formed of a rigid material having a high shear strength, such as a metallic material. The elongated members are typically formed of a high tensile strength material which is generally more flexible than the rigid material used to form the brackets. However, in some instances, where the appliance is particularly heavy, the elongated members may also be formed from a rigid high shear strength material.

The appliance securing device of the present invention generally allows for some movement in and out of the major plane of the bracket plate, but does not allow for movement along a length of the elongated members after attachment of the elongated members to the support surface.

In its most common form, the present invention generally comprises a pair of brackets and a plurality of securing members that are adapted for selectively attaching the brackets to a rear side of an appliance. Each bracket is attached to an elongated member having a first end and a second end. The first end of the elongated member is pivotally attached to one of the brackets. The second end of the elongated member is pivotally attached to a supporting structure such as a wall or a wall baseboard via a fastener which passes through the second end of the elongated member. Typically the elongated member passes through an aperture which is spaced a nominal distance along the length of the elongated member in a direction away from the pivotal attachment point of the bracket.

The more important features of the inventive appliance attachment device have been outlined, rather broadly above, and a more detailed description of the device follows below, with the present contribution to the art being illustrated in the claims which are appended to this application.

BRIEF DESCRIPTION OF THE DRAWINGS

The details of the invention will become apparent when consideration is given to the detailed description which follows; such description makes reference to the annexed drawings wherein.

DESCRIPTION OF THE PREFERRED EMBODIMENT

Figure 1:
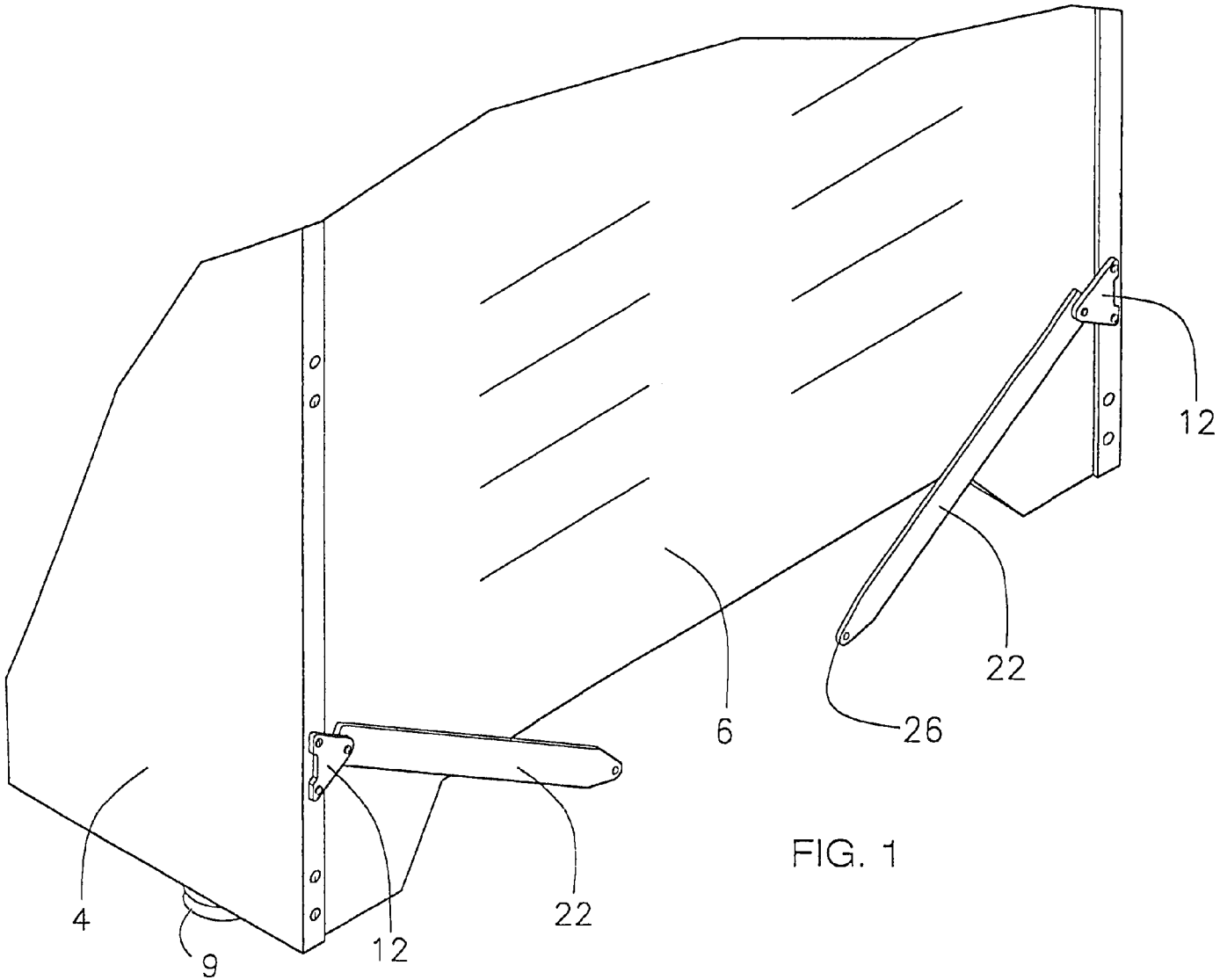
FIG. 1 is a schematic perspective view of an appliance stabilizing device according to the present invention, illustrating a bracket 12 attached to an appliance, where the bracket 12 is pivotally attached to an elongated member 22 which is used to attach the appliance to a support structure.
Figure 2:
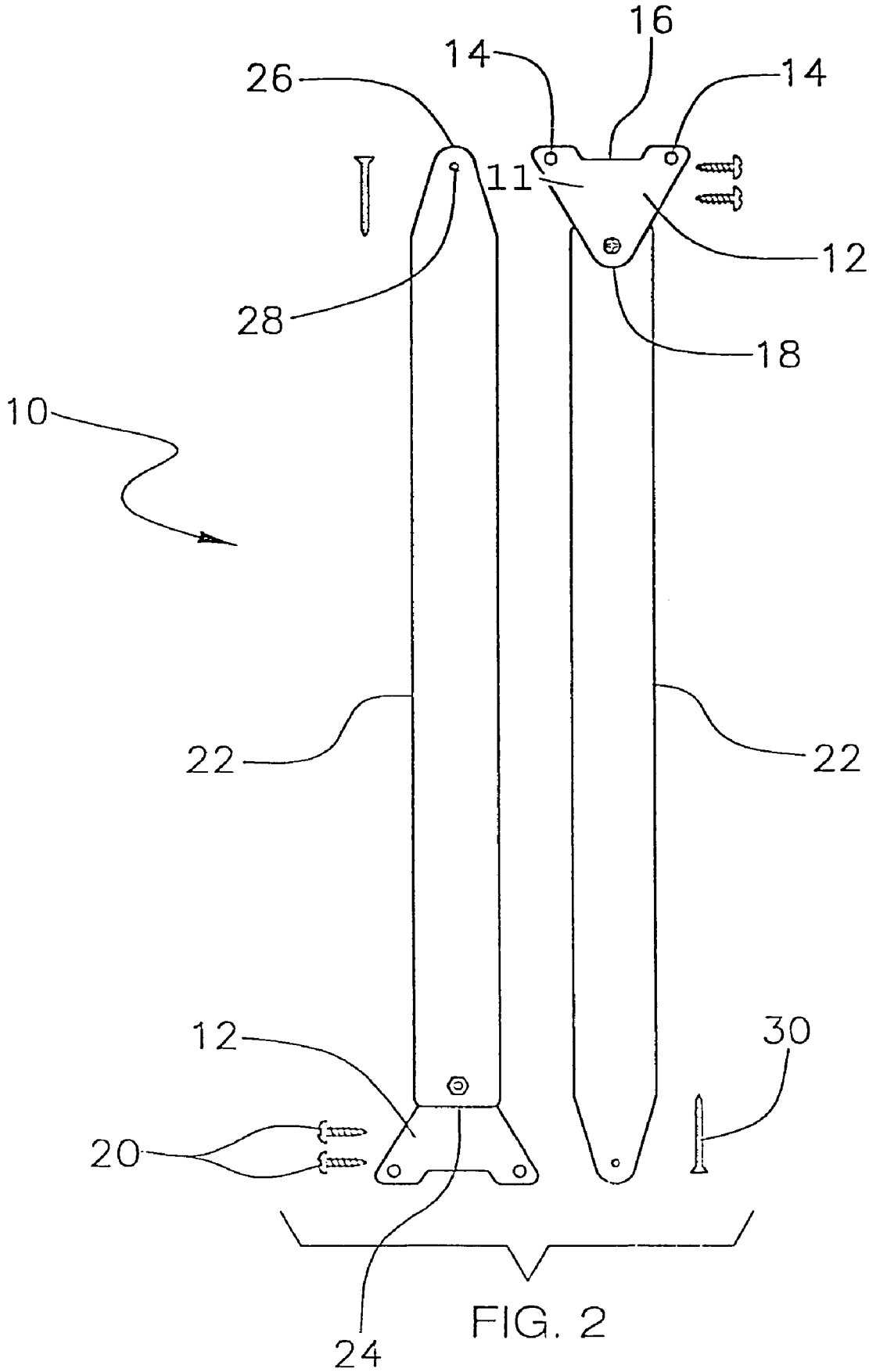
FIG. 2 is a schematic plan view illustrating elongated members 22 and a bracket 12 in more detail, including exemplary means for attachment of the bracket 12 to the plate 12.
Figure 3:
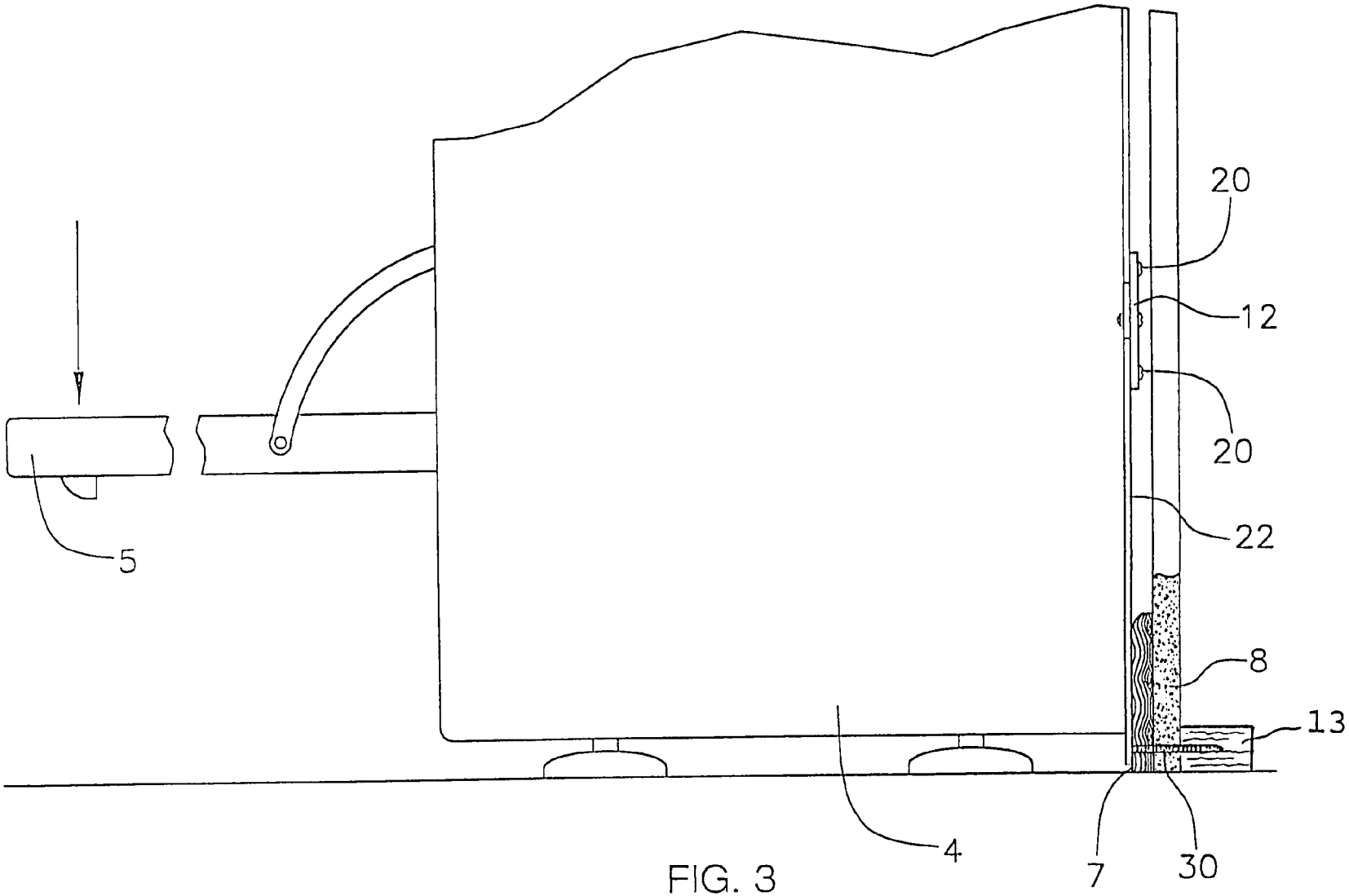
FIG. 3 is a schematic side in-use view of the present invention, where the appliance attachment device is attached to appliance 4 by securing members 20 which affix bracket 12 to appliance 4, where elongated member 22 is pivotally attached to bracket 12, and where elongated member 22 is attached through a baseboard 7, a wall structure 8, and a wall plate 13, by fastener 30, which is typically threaded, as shown.

With reference now to the drawings, and in particular to FIGS. 1 through 3 thereof, a new appliance securing member embodying the principles and concepts of the present invention and generally designated by the reference numeral 10 will be described.

As best illustrated in FIGS. 1 through 3, the appliance stabilizing device 10 generally comprises at least two brackets 12. Each of the brackets includes a plate 11. The plate 11 of bracket 12 has at least three apertures 14 extending therethrough. The apertures 14 are spaced from each other to form a generally triangular configuration, or another configuration providing stability at least equal to that provided by the triangular configuration. One skilled in the art can envision a number of stable configurations, but a triangular configuration of the kind shown in FIGS. 1 and 2 is the simplest stable design. The plates 11 shown in FIGS. 1 and 2 are also triangular in configuration, but it is obvious to one of skill in the art that it is not necessary to have a triangular plate to have the stable attachment which is provided by the triangular configuration of the apertures. For example, the plate 11 of bracket 12 could have a generally rectangular shape while having apertures positioned in a triangular configuration. The bracket 12 is positioned relative to the appliance so that the base 16 is attached to a rigid portion of the appliance, while the portion 18 of the bracket 12 to which the elongated members 22 is pivotally attached contains the aperture which forms the apex of the triangular configuration of apertures. The apertures 14 of base 16 are preferably positioned generally adjacent an edge of the base 16.

The brackets 12 are typically, but not by way of limitation, formed from a steel plate which ranges in thickness from about 16 gauge, U.S. Standard, (about 1/16 inch) to about 3 gauge, U.S. Standard, (about 1/4 inch), more typically, the bracket thickness ranges from about 16 gauge to about 11 gauge (about 1/8 inch). The elongated members are typically, but not by way of limitation, constructed from metal straps, or strips, such as steel strips, where the strapping ranges in thickness from about 22 gauge, U.S. Standard (about 0.031 inches) to about 11 gauge, U.S. Standard (about 1/8 inch), depending on the weight of the appliance.

Each of a plurality of securing members 20 is adapted for selectively attaching the brackets 12 to a rear side 6 of an appliance 4. The securing members 20 each typically, but not by way of limitation, comprise a threaded member, such as a bolt or screw, which is extendable through one of the apertures 14 and into the appliance 4. Alternatively, clamps or other mechanical fasteners may also be utilized.

Each of (frequently a pair of) the of elongated members 22 has a first end 24 and a second end 26. The first end 24 is pivotally attached to one of the brackets 12. The elongated members 22 each have at least one opening 28 extending therethrough. The opening 28 is positioned generally adjacent to the second end 26 of the elongated member 22. One skilled in the art will recognize that a series of separate openings may be present extending in a lengthwise direction of the elongated member 22 toward the second end 26 of the elongated member, so that one length of elongated member may be used for more applications. The first ends 24 are preferably positioned to work in combination with the plate 11 of bracket 12, so that the elongated member 22 can pivot in a plane which is parallel with the plane of the major surface of bracket 12. As previously described, the plate 11 of bracket 12 is ideally comprised of a metallic material. Each of the elongate members 22 preferably lies in a plane which is co-planar with an attached one of said plates 11.

At least one fastener 30 is removably extendable through one of the at least one openings present near the second end 26 of elongated member 22, for selectively attaching elongated member 22 to a wall 8, in a manner similar to that shown in FIG. 3. As illustrated in FIG. 3, in some instances the fastener 30 may pass through a baseboard 7, into a general wall structure 8 (such as a dry wall structure), and further into a wall plate 13 which lies behind the general wall structure 8. This adds additional strength to the attachment. In other instances, the fastener 30 may pass through a general wall structure 8 and into a wall plate 13. In other instances, depending on where the elongated member 22 is attached to a general wall structure 8, a baseboard 7 and a wall plate 13 may not be present and an insert (not shown) may be used in the general wall structure 8 to provide additional strength for the attachment of fastener 30 which passes through at least a portion of the insert.

In use, the brackets 12 are typically attached to the appliance 4, such as an oven, on either side edge of a rear portion 6 of the oven, as shown in FIG. 1. The elongated members 22 are positioned so that their second ends 26 are adjacent to a wall structure 8, and possibly a baseboard 7, and a wall plate 13, as illustrated in FIG. 3. The fasteners 30 preferably include a threaded configuration to provide more surface area for attachment and to provide better contact with a baseboard 7, wall structure 8, and wall plate 13. As previously mentioned, an insert (not shown) may be used in a wall structure 8, with a fastener inserted into the insert present in wall structure 8.

With reference to FIG. 3, the attachment to the wall structure is then made at a location which is at a height which is relatively near the bottom of the appliance. When there is an event which might cause the appliance to tip away from wall structure 8, a load is transferred from the appliance 4 through the bracket 12 to the elongated member 11, and to the point of attachment of fastener 30 at the wall structure 8 (and possibly through a baseboard 7 and/or a wall plate 13. The appliance stabilizing device of the present invention directs the fastener 30 in the wall structure 8 (and possibly baseboard 7 and/or wall plate 13) to move upward through the wall structure 8 material (and possibly baseboard 7 and/or wall plate 13) material, rather than to pull directly out in a direction perpendicular to the wall or wall baseboard. When compared to prior designs for devices used to attach an appliance to a wall, the present design significantly improves the probability that the appliance will not tip over when the appliance is subjected to a tipping force.

The device 10 prevents the tipping of the appliance 4, such as when the door 5 of an oven is opened, as illustrated in FIG. 3, and stepped upon by a child, by way of example. The brackets 12 may be positioned so that the elongate members 22 are selectively positioned against the wall structure 8. The elongate members 22 are pivotally attached to the brackets 12 to further aid in the placement of the second ends 26, to permit limited movement during an earthquake in a manner which helps stabilize the appliance in combination with the wall structure, and to permit leveling of the appliance using the leveling feet 9 of the kind shown in FIG. 1, which leveling feet 9 are commonly known within the appliance industry.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of preventing an appliance from tipping over, said method comprising the steps of:

providing an appliance;

providing an apparatus which includes at least two brackets, each of said brackets including a plate, each of said plates having at least three apertures extending therethrough, said apertures being spaced from each other to form a generally triangular configuration or another configuration providing stability at least equal to that provided by said triangular configuration;

attaching each of said at least two brackets to a rear side of an appliance using at least two securing members in each bracket, where each securing member comprises a member which is extended through one of said apertures in said bracket plate and into said rear side of said appliance, and where said apertures through which said securing members pass form the base of said generally triangular configuration or form the base of said other configuration which provides equal stability;

attaching a first end of an elongated member having a first end and a second end to each of said bracket plates such that said elongated member is pivotally attached by a fastener through an aperture at an apex of said generally triangular configuration within said bracket plate, when said apertures form a generally triangular configuration, or attaching said first end of said elongated member at an aperture located at an extended distance from another aperture in said bracket plate, when said apertures form said another configuration providing stability; and attaching a second end of each of said elongated members to a wall facing said rear side of said appliance using a fastener, in a manner such that each of said elongated members is attached to the same wall.

2. A method in accordance with claim 1, wherein said securing members are passed through a rigid portion of a framework of said appliance.

3. A method in accordance with claim 1, wherein said elongated members are attached to said wall so that as an upper portion of said appliance begins to tip away from said wall, the portion of said elongated member in contact with said wall is pushed toward said wall, whereby the ability of said elongated member to remain attached to said wall is improved.

4. A method in accordance with claim 1, wherein said elongated members are attached to said wall at a baseboard of said wall.

5. A method in accordance with claim 1, wherein said elongated members are selected to be formed from a metallic material which permits some movement into and out of a plane on which a bracket is mounted, but does not allow for movement along a length of an elongated member.

* * * * *